US011308900B2

(12) United States Patent
Strandborg et al.

(10) Patent No.: US 11,308,900 B2
(45) Date of Patent: Apr. 19, 2022

(54) DISPLAY APPARATUS AND METHOD INCORPORATING SUB-PIXEL AWARE SHIFTING AND OVERLAP COMPENSATION

(71) Applicant: Varjo Technologies Oy, Helsinki (FI)

(72) Inventors: Mikko Strandborg, Hangonkylä (FI); Klaus Melakari, Espoo (FI); Ville Miettinen, Helsinki (FI)

(73) Assignee: Varjo Technologies Oy, Helsinki (FI)

( * ) Notice: Subject to any disclaimer, the term of this patent is extended or adjusted under 35 U.S.C. 154(b) by 0 days.

(21) Appl. No.: 17/167,233

(22) Filed: Feb. 4, 2021

(65) Prior Publication Data

US 2021/0248969 A1 Aug. 12, 2021

Related U.S. Application Data

(63) Continuation-in-part of application No. 16/783,557, filed on Feb. 6, 2020, now Pat. No. 11,056,030.

(51) Int. Cl.
*G09G 5/02* (2006.01)
*G09G 5/10* (2006.01)
(Continued)

(52) U.S. Cl.
CPC ... *G09G 3/3607* (2013.01); *G09G 2300/0871* (2013.01); *G09G 2320/0242* (2013.01); *G09G 2340/0457* (2013.01)

(58) Field of Classification Search
CPC ..... G06F 3/013; G09G 3/2003
See application file for complete search history.

(56) References Cited

U.S. PATENT DOCUMENTS 5,742,264 A 4/1998 Inagaki et al.
6,456,340 B1 * 9/2002 Margulis ..... G06T 1/20 345/501

(Continued)

FOREIGN PATENT DOCUMENTS

WO 2013171168 A1 11/2013

OTHER PUBLICATIONS

International Search Report and Written Opinion of the International Searching Authority, Application No. PCT/FI2021/050082, dated Apr. 23, 2021, 19 pages.

(Continued)

*Primary Examiner* — Nan-Ying Yang
(74) *Attorney, Agent, or Firm* — Ziegler IP Law Group, LLC

(57) ABSTRACT

In a display apparatus, a liquid-crystal structure, arranged in front of an image renderer, is controlled to shift light of a given sub-pixel to target positions according to a shifting sequence in a repeated manner, while output image frames are displayed. To generate a given output image frame, a given target position to which the light is to be shifted is determined based on the shifting sequence. An input colour value of the given sub-pixel provided in a given input image frame is then adjusted to generate an output colour value of the given sub-pixel for the given output image frame, based on an output colour value of at least one other sub-pixel whose light overlaps with the given target position during display of a previous output image frame, and a retention coefficient between a colour of the at least one other sub-pixel and a colour of the given sub-pixel.

12 Claims, 3 Drawing Sheets

(51) Int. Cl.
*G09G 5/00* (2006.01)
*G09G 3/36* (2006.01)

(56) References Cited

U.S. PATENT DOCUMENTS

| | | | | |
|---|---|---|---|---|
| 9,710,887 | B1 | 7/2017 | Sahlsten et al. | |
| 2002/0008812 | A1* | 1/2002 | Conner ..... | G02B 27/1066 349/106 |
| 2017/0270637 | A1 | 9/2017 | Perreault et al. | |
| 2018/0053284 | A1 | 2/2018 | Rodriguez et al. | |
| 2018/0075820 | A1 | 3/2018 | Hicks et al. | |
| 2019/0243134 | A1 | 8/2019 | Perreault et al. | |
| 2019/0318677 | A1 | 10/2019 | Lu et al. | |
| 2019/0354173 | A1 | 11/2019 | Young et al. | |

OTHER PUBLICATIONS

Notification of Transmittal of the International Search Report and the Written Opinion of the International Searching Authority, or The Declaration, Application No. PCT/FI2020/050073, dated Apr. 30, 2021, 17 pages.

PCT, Notification of Transmittal of the International Search Report and the Written Opinion of the International Searching Authority, or the Declaration, Application No. PCT/FI2021/050085, dated Jun. 14, 2021, 29 pages.

* cited by examiner

DISPLAY APPARATUS AND METHOD INCORPORATING SUB-PIXEL AWARE SHIFTING AND OVERLAP COMPENSATION

CROSS-REFERENCE TO RELATED APPLICATIONS

This application is a continuation-in-part of U.S. patent application Ser. No. 16/783,557, titled "DISPLAY APPARATUS AND METHOD OF ENHANCING APPARENT RESOLUTION USING LIQUID-CRYSTAL DEVICE" and filed on Feb. 6, 2020, which is incorporated herein by reference.

TECHNICAL FIELD

The present disclosure relates to a display apparatus comprising an image renderer and a liquid-crystal device employed to shift light emanating from the image renderer. The present disclosure also relates to a method of displaying via the aforesaid display apparatus.

BACKGROUND

Contemporarily, pixel-shifting technology has been used in display devices with an aim to achieve an apparent increase in spatial resolution. In this technology, a liquid-crystal device is employed in combination with an image renderer (for example, such as a display or a projector) to shift light emanating from a given pixel of the image renderer to multiple positions, thereby filling gaps between adjacent pixels.

However, such pixel-shifting causes light emanating from adjacent pixels to overlap in spatial domain. This, in turn, produces colour errors that are perceptible to a human eye.

Therefore, in light of the foregoing discussion, there exists a need to overcome the aforementioned drawbacks associated with the contemporary pixel-shifting technology.

SUMMARY

The present disclosure relates to display apparatuses. The present disclosure also relates to methods for displaying via the aforesaid display apparatuses. Furthermore, the present disclosure also seeks to provide a solution to the existing problems of display apparatuses employing liquid-crystal devices for pixel-shifting.

In a first aspect, an embodiment of the present disclosure provides a display apparatus comprising:

an image renderer having a plurality of pixels, a given pixel comprising at least three sub-pixels;

a liquid-crystal device comprising a liquid-crystal structure and a control circuit, wherein the liquid-crystal structure is arranged in front of an image-rendering surface of the image renderer, wherein the liquid-crystal structure is to be electrically controlled, via the control circuit, to shift light emanating from a given sub-pixel of the image renderer to a plurality of target positions on an image plane according to a shifting sequence in a repeated manner; and at least one processor configured to:

process an input sequence of input image frames to generate an output sequence of output image frames; and display the output image frames in the output sequence, wherein, when processing a given input image frame to generate a given output image frame, the at least one processor is configured to:

determine a given target position on the image plane to which the light emanating from the given sub-pixel of the image renderer is to be shifted during display of the given output image frame, based on the shifting sequence;

adjust an input colour value of the given sub-pixel provided in the given input image frame to generate an output colour value of the given sub-pixel for the given output image frame, based on:

an output colour value of at least one other sub-pixel of the image renderer whose light overlaps with the given target position on the image plane during display of at least one previous output image frame, and a retention coefficient between a colour of the at least one other sub-pixel and a colour of the given sub-pixel.

In a second aspect, an embodiment of the present disclosure provides a method of displaying, via a display apparatus comprising an image renderer and a liquid-crystal device, the image renderer having a plurality of pixels, a given pixel comprising at least three sub-pixels, the liquid-crystal device comprising a liquid-crystal structure and a control circuit, wherein the liquid-crystal structure is arranged in front of an image-rendering surface of the image renderer, the method comprising:

electrically controlling the liquid-crystal structure, via the control circuit, to shift light emanating from a given sub-pixel of the image renderer to a plurality of target positions on an image plane according to a shifting sequence in a repeated manner;

processing an input sequence of input image frames to generate an output sequence of output image frames, wherein the step of processing a given input image frame to generate a given output image frame comprises:

determining a given target position on the image plane to which the light emanating from the given sub-pixel of the image renderer is to be shifted during display of the given output image frame, based on the shifting sequence; and adjusting an input colour value of the given sub-pixel provided in the given input image frame to generate an output colour value of the given sub-pixel for the given output image frame, based on an output colour value of at least one other sub-pixel of the image renderer whose light overlaps with the given target position on the image plane during display of at least one previous output image frame, and a retention coefficient between a colour of the at least one other sub-pixel and a colour of the given sub-pixel; and displaying the output image frames in the output sequence.

Embodiments of the present disclosure substantially eliminate or at least partially address the aforementioned problems in the prior art, and facilitate an enhancement in colour reproduction capabilities of the display apparatus, while reducing colour errors arising due to overlap of light emanating from different sub-pixels.

Additional aspects, advantages, features and objects of the present disclosure would be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those in the art will understand that the drawings are not to scale. Wherever possible, like elements have been indicated by identical numbers.

Embodiments of the present disclosure will now be described, by way of example only, with reference to the following diagrams wherein.

Figure 1:
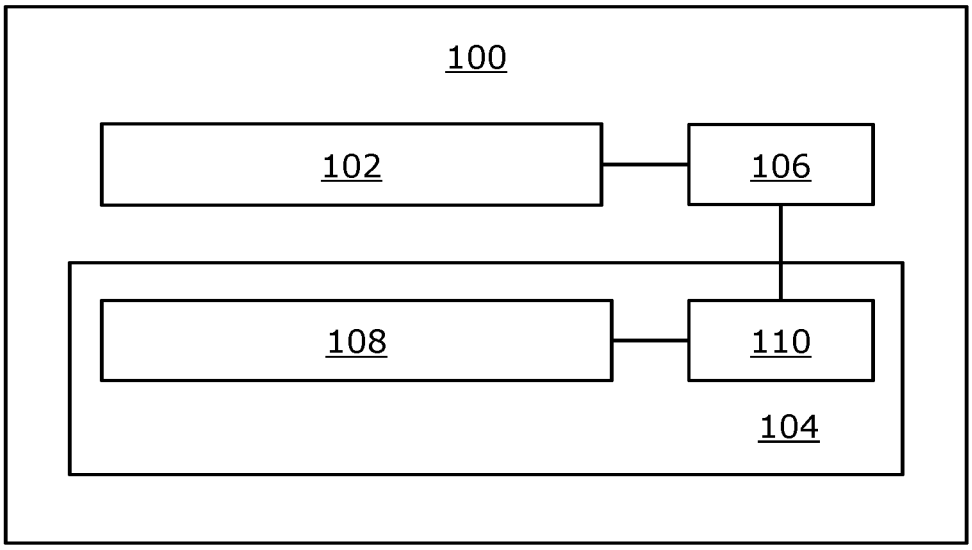
FIG. 1 is a block diagram of architecture of a display apparatus, in accordance with an embodiment of the present disclosure.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF EMBODIMENTS

The following detailed description illustrates embodiments of the present disclosure and ways in which they can be implemented. Although some modes of carrying out the present disclosure have been disclosed, those skilled in the art would recognize that other embodiments for carrying out or practicing the present disclosure are also possible.

In a first aspect, an embodiment of the present disclosure provides a display apparatus comprising:

an image renderer having a plurality of pixels, a given pixel comprising at least three sub-pixels;

a liquid-crystal device comprising a liquid-crystal structure and a control circuit, wherein the liquid-crystal structure is arranged in front of an image-rendering surface of the image renderer, wherein the liquid-crystal structure is to be electrically controlled, via the control circuit, to shift light emanating from a given sub-pixel of the image renderer to a plurality of target positions on an image plane according to a shifting sequence in a repeated manner; and at least one processor configured to:

process an input sequence of input image frames to generate an output sequence of output image frames; and display the output image frames in the output sequence, wherein, when processing a given input image frame to generate a given output image frame, the at least one processor is configured to:

determine a given target position on the image plane to which the light emanating from the given sub-pixel of the image renderer is to be shifted during display of the given output image frame, based on the shifting sequence;

adjust an input colour value of the given sub-pixel provided in the given input image frame to generate an output colour value of the given sub-pixel for the given output image frame, based on:

an output colour value of at least one other sub-pixel of the image renderer whose light overlaps with the given target position on the image plane during display of at least one previous output image frame, and a retention coefficient between a colour of the at least one other sub-pixel and a colour of the given sub-pixel.

In a second aspect, an embodiment of the present disclosure provides a method of displaying, via a display apparatus comprising an image renderer and a liquid-crystal device, the image renderer having a plurality of pixels, a given pixel comprising at least three sub-pixels, the liquid-crystal device comprising a liquid-crystal structure and a control circuit, wherein the liquid-crystal structure is arranged in front of an image-rendering surface of the image renderer, the method comprising:

electrically controlling the liquid-crystal structure, via the control circuit, to shift light emanating from a given sub-pixel of the image renderer to a plurality of target positions on an image plane according to a shifting sequence in a repeated manner;

processing an input sequence of input image frames to generate an output sequence of output image frames, wherein the step of processing a given input image frame to generate a given output image frame comprises:

determining a given target position on the image plane to which the light emanating from the given sub-pixel of the image renderer is to be shifted during display of the given output image frame, based on the shifting sequence; and adjusting an input colour value of the given sub-pixel provided in the given input image frame to generate an output colour value of the given sub-pixel for the given output image frame, based on an output colour value of at least one other sub-pixel of the image renderer whose light overlaps with the given target position on the image plane during display of at least one previous output image frame, and a retention coefficient between a colour of the at least one other sub-pixel and a colour of the given sub-pixel; and displaying the output image frames in the output sequence.

In the aforementioned display apparatus and method, the technical effect of adjusting the input colour value of the given sub-pixel for the given output image frame, based on the output colour value of the at least one other sub-pixel in the at least one previous output image frame and the retention coefficient between the colour of the at least one other sub-pixel and the colour of the given sub-pixel, is that colour reproduction capabilities of the display apparatus are enhanced. This takes into consideration a fact that a visual stimulus produced by the colour of the at least one other sub-pixel is retained to a certain extent after the at least one previous output image frame is displayed and, therefore, has an effect on a visual stimulus produced by the colour of the given sub-pixel during the display of the given output image frame. Thus, the aforementioned adjustment in the input colour value of the given sub-pixel compensates for this effect, thereby reducing a colour error perceivable to the user. This, in turn, provides an immersive and realistic user experience to the user while she/he is viewing a visual scene being presented via the display apparatus. Moreover, shifting the light emanating from the given sub-pixel to cover the plurality of target positions greatly enhances an apparent spatial resolution of the display apparatus as compared to an actual display resolution of the image renderer.

It will be appreciated that the light emanating from the at least one other sub-pixel during the display of the at least one previous output image frame may overlap either partially or fully with the given target position on the image plane. Thus, the adjustment in the input colour value of the given sub-pixel is optionally performed based on an extent to which the light of the at least one other sub-pixel overlaps with the given target position during the display of the at least one previous output image frame (hereinafter referred to as the "extent of overlap", for the sake of convenience). In this regard, the extent of overlap could be measured as a percentage of a total area covered by the light emanating from the given sub-pixel around the given target position.

Pursuant to embodiments, the plurality of target positions (to which the light emanating from the given sub-pixel is to be shifted) comprises an original position of the light, namely in a case where the light passes unbent. The plurality of target positions lie in a proximity of an actual physical position of the given sub-pixel, as the light is shifted to beneficially fill up gaps between adjacent pixels and their sub-pixels. Each target position could be determined as position coordinates in a two-dimensional coordinate space representing the image plane.

Notably, each of the sub-pixels occupies a different physical position on the image-rendering surface of the image renderer. Optionally, the light is shifted by a fraction of a pixel in a given direction. Throughout the present disclosure, the term "at least one other sub-pixel" refers to at least one sub-pixel that is located in the proximity of the given sub-pixel. A distance between the given sub-pixel and the at least one other sub-pixel can be measured at a pixel level. Optionally, this distance is at most one pixel. By definition, "one pixel" is equal to a distance between centres of two adjacent pixels.

Throughout the present disclosure, the term "given target position" refers to one of the plurality of target positions at which the light emanating from the given sub-pixel is to be shifted during the display of the given output image frame. Depending on the shifting sequence, the light is to be shifted to different target positions during display of consecutive output image frames.

Throughout the present disclosure, the term "colour value" refers to a measure of an intensity (namely, brightness) of a given colour produced by a given sub-pixel. A given colour value is represented using a predetermined number of bits, which may, for example, be 8 bits, 10 bits, 16 bits, 32 bits, and the like.

Optionally, the at least one processor is configured to map the input colour value of the given sub-pixel and the output colour value of the at least one other sub-pixel to lie in a range of 0-1, prior to performing the aforesaid adjustment. In the range of 0-1, '0' indicates a lowest intensity value (that is, minimum brightness) of the given colour, while '1' indicates a highest intensity value (that is, maximum brightness) of the given colour. The aforesaid mapping could be performed by employing a normalization function, which maps a given colour value that lies in a first range to a corresponding colour value that lies in the range of 0-1. The first range pertains to the number of bits that are required to represent the given colour value, and may, for example, be a range of 0-255, a range of 0-1023, or similar. It will be appreciated that the input colour value of the given sub-pixel and the output colour value of the at least one other sub-pixel may be provided using different number of bits, and thus, may lie in different ranges. This is particularly applicable in a case where quantization is performed to generate a given output value from a given input value.

Additionally, in such a case, the at least one processor is optionally configured to re-map the output colour value of the given sub-pixel to lie in a second range, after performing the aforesaid adjustment. This second range pertains to the number of bits that are required to represent the output colour value in the display apparatus, and may, for example, be a range of 0-255, a range of 0-1023, or similar. The aforesaid re-mapping could be performed by employing a de-normalization function, which maps a given colour value that lies in the range of 0-1 to a corresponding colour value that lies in the second range.

Throughout the present disclosure, the term "retention coefficient" refers to a coefficient that represents an extent to which the visual stimulus produced by the colour of the at least one other sub-pixel is retained and a manner in which the retained visual stimulus affects the visual stimulus produced by the colour of the given sub-pixel. The "extent" refers to a magnitude of the retention coefficient, whereas the "manner" refers to a sign of the retention coefficient (namely, whether a luminosity of the colour of the at least one other sub-pixel boosts or dampens a luminosity of the colour of the given sub-pixel). The retention coefficient lies optionally in a range of −0.4 to +0.8; more optionally, in a range of −0.2 to +0.4; yet more optionally, in a range of −0.1 to +0.2. For example, the retention coefficient may lie in a range from −0.5, −0.4, −0.3, −0.2, −0.1 or 0 up to 0.1, 0.2, 0.3, 0.4, 0.5, 0.6, 0.7, 0.8, 0.9 or 0.95. A zero value of the retention coefficient means that there is no effect of the luminosity of the colour of the at least one other sub-pixel on the luminosity of the colour of the given sub-pixel upon overlap. Depending on how the sign of the retention coefficient is considered, a positive value of the retention coefficient could mean that the luminosity of the colour of the at least one other sub-pixel boosts the luminosity of the colour of the given sub-pixel, whereas a negative value of the retention coefficient could mean that the luminosity of the colour of the at least one other sub-pixel dampens the luminosity of the colour of the given sub-pixel. Thus, the retention coefficient is employed to compensate for the effect of the luminosity of the colour of the at least one other sub-pixel on the luminosity of the colour of the given sub-pixel upon overlap.

Furthermore, it will be appreciated that retention coefficients are determined for different pairs of colours that are available in the display apparatus. Notably, the sub-pixels of the plurality of pixels in the image renderer are arranged in a specific sub-pixel arrangement. In an example of an RGB sub-pixel arrangement, a pixel comprises three sub-pixels, namely one red, one green and one blue. In another example of a PenTile® matrix sub-pixel arrangement, a pixel comprises five sub-pixels, namely two red, two green and one blue. In such cases, the different pairs of colours would be red-green, red-blue and green-blue. In yet another example of an RGBW sub-pixel arrangement, a pixel comprises four sub-pixels, namely one red, one green, one blue and one white. In such a case, the different pairs of colours would be red-green, red-blue, red-white, green-blue, green-white and blue-white. In still another example of a CMY sub-pixel arrangement, a pixel comprises three sub-pixels, namely one cyan, one magenta and one yellow. In such a case, the different pairs of colours would be cyan-magenta, cyan-yellow and magenta-yellow.

Depending on the sub-pixel arrangement of the image renderer and the shifting sequence in which the light emanating from the given sub-pixel is to be shifted to the plurality of target positions, it is determined which colours would be displayed successively at the given target position. It will be appreciated here that a retention coefficient for a given pair of colours need not be symmetric. As an example, a retention coefficient for a red to green transition would be different from a retention coefficient for a green to red transition.

It will also be appreciated that photoreceptors cells of a human eye respond differently to different colours of a colour spectrum; that is, the photoreceptors cells have different responsivity to the different colours. As a result, the luminosity of the colour of the at least one other sub-pixel would bleed over the luminosity of the colour of the given sub-pixel, and would either boost or dampen the luminosity of the colour of the given sub-pixel. As an example, the responsivity of cone cells to red and green colours is known to overlap quite considerably. Consider a case where the output colour value of the at least one other sub-pixel corresponds to a bright green light, while the input colour value of the given sub-pixel corresponds to a dim red light. If the input colour value of the given sub-pixel were not adjusted, the luminosity of the bright green light produced by the at least one other sub-pixel would boost the luminosity of the dim red light produced by the given sub-pixel; as a result, the user would perceive the red light as being brighter than what it actually is. On the other hand, if the input colour value of the given sub-pixel were adjusted (dimmed even further, in this case) pursuant to the aforementioned method to compensate for the effect of overlap, the user would perceive the red light as what it is intended to be. Thus, the retention coefficient is beneficially determined based on the responsivity of the photoreceptor cells of the human eye to the different colours of the colour spectrum. The retention coefficient may be determined particularly based on the responsivity of the cone cells to the different colours.

Additionally, optionally, the retention coefficient is determined by employing an experimental setup, where pre-known colour values are displayed by a plurality of sub-pixels in succession, whilst shifting light emanating therefrom to the given target position in succession, and an amount of colour error perceived is measured; the amount of colour error is then reduced by altering the retention coefficient iteratively.

Moreover, the retention coefficient depends on the time elapsed between display of two consecutive output image frames. Optionally, in this regard, the at least one processor is configured to determine the retention coefficient between the colour of the at least one other sub-pixel and the colour of the given sub-pixel, based on a frame rate of the image renderer. It will be appreciated that the frame rate is typically constant for the image renderer; in such a case, the retention coefficient would also be constant. However, in an alternative case where the frame rate of the image renderer is controlled adaptively, the liquid-crystal device is required to be controlled accordingly; in such a case, the retention coefficient would also be determined accordingly. Thus, the retention coefficient is an adjustable parameter.

Furthermore, in some implementations, the at least one previous output image frame comprises a single output image frame that is displayed just prior to the given output image frame. In such implementations, the at least one other sub-pixel comprises a single sub-pixel that lies in a proximity of the given sub-pixel and whose light overlaps with the given target position during the display of the single output image frame.

In other implementations, the at least one previous output image frame comprises a plurality of output image frames that are displayed prior to the given output image frame. In such implementations, the at least one other sub-pixel comprises a plurality of sub-pixels that lie in a proximity of the given sub-pixel and whose light overlap with the given target position during the display of corresponding output image frames.

For illustration purposes only, there will now be considered an example equation that mathematically represents how the aforesaid adjustment can be made in an example implementation.

$$C_{out}=C_{in}-B*C_{previous}$$

where:

'$C_{out}$' represents the output colour value of the given sub-pixel for the given output image frame, '$C_{in}$' represents the input colour value of the given sub-pixel in the given input image frame, '$C_{previous}$' represents the output colour value of the at least one other sub-pixel in the at least one previous output image frame, and 'B' represents the retention coefficient between the colour of the at least one other sub-pixel and the colour of the given sub-pixel.

In a case where colour values are normalized as described earlier, the value derived from the right-hand side of the example equation is clamped to lie in the range of 0-1.

In a first example where $C_{in}=0.5$, $C_{previous}=1$ and $B=0.1$, $C_{out}$ would be calculated as 0.4.

In a second example where $C_{in}=0.5$, $C_{previous}=0$ and $B=0.2$, $C_{out}$ would be calculated as 0.5.

In a third example where $C_{in}=0.1$, $C_{previous}=1$ and $B=-0.15$, $C_{out}$ would be calculated as 0.

In a fourth example where $C_{in}=0.9$, $C_{previous}=1$ and $B=-0.15$, $C_{out}$ would be calculated as 1.

It will be appreciated that the aforementioned example equation is merely an example, wherein the at least one other sub-pixel is considered to include only one sub-pixel. Hereinabove, a positive value of the retention coefficient is considered to correspond to a case where the previous colour boosts the current colour, whereas a negative value of the retention coefficient is considered to correspond to a case where the previous colour dampens the current colour. The person skilled in the art will recognize many variations, alternatives, and modifications of the example equation.

In a specific implementation, the at least one previous output image frame comprises a first output image frame and a second output image frame, and the at least one other sub-pixel comprises a first sub-pixel and a second sub-pixel, wherein light emanating from the first sub-pixel is shifted to the given target position on the image plane during display of the first output image frame, and light emanating from the second sub-pixel is shifted to the given target position on the image plane during display of the second output image frame, the second output image frame being displayed subsequent to the first output image frame, wherein the given output image frame is to be displayed subsequent to the second output image frame. Optionally, in such an implementation, when adjusting the input colour value of the given sub-pixel, the at least one processor is configured to apply a first weightage and a second weightage to a first retention coefficient between a colour of the first sub-pixel and the colour of the given sub-pixel and a second retention coefficient between a colour of the second sub-pixel and the colour of the given sub-pixel, respectively, the second weightage being greater than the first weightage. The technical effect of giving a higher weightage to a retention coefficient of a most-recently-displayed colour as compared to a retention coefficient of another previously-displayed colour is that colours are reproduced more accurately in the display apparatus.

Moreover, the first weightage and the second weightage could be pre-determined. Optionally, the first weightage and the second weightage are determined based on the time elapsed from the display of the first output image frame and the second output image frame, respectively, to the display of the given output image frame. Such determination could beneficially be performed by employing the aforementioned experimental setup. Additionally or alternatively, the first weightage and the second weightage could be determined using a machine learning algorithm.

For illustration purposes only, there will now be considered another example equation that mathematically represents how the aforesaid adjustment can be made in the other example implementation.

$$C_{out}=C_{in}-W_1*B_1*C_{p1}-W_2*B_2*C_{p2}$$

where:

'$C_{out}$' and '$C_{in}$' represent the output colour value and the input colour value of the given sub-pixel, respectively, '$C_{p1}$' and '$C_{p2}$' represent the output colour value of the first sub-pixel in the first output image frame and the output colour value of the second sub-pixel in the second output image frame, respectively, '$B_1$' and '$B_2$' represent the first retention coefficient and the second retention coefficient, respectively, and '$W_1$' and '$W_2$' represent the first weightage and the second weightage, respectively.

In a case where colour values are normalized as described earlier, the value derived from the right-hand side of the other example equation is clamped to lie in the range of 0-1. It will be appreciated that the other example equation is merely another example. The person skilled in the art will recognize many variations, alternatives, and modifications of the other example equation.

Furthermore, examples of the display apparatus include, but are not limited to, an extended-reality (XR) headset, a pair of XR glasses, an XR console, a television, a monitor, a laptop, a tablet, a smartphone and a smartwatch. Throughout the present disclosure, the term "image renderer" refers to a display or a projector, the term "image rendering surface" refers to a surface of the image renderer from which the light emanates, and the term "display resolution" of the image renderer refers to a total number of pixels in each dimension of the image renderer, or to a pixel density (namely, a number of pixels per unit distance, area or degree) in the image renderer. Examples of the display include, but are not limited to, a Liquid Crystal Display (LCD), a Cathode-Ray Tube (CRT) display, a Light-Emitting Diode (LED)-based display, an Organic LED (OLED)-based display, a micro OLED-based display, an Active Matrix OLED (AMOLED)-based display, and a Liquid Crystal on Silicon (LCoS)-based display. Examples of the projector include, but are not limited to, an LCD-based projector, an LED-based projector, an OLED-based projector, an LCoS-based projector, a Digital Light Processing (DLP)-based projector, and a laser projector.

Throughout the present disclosure, the term "liquid-crystal device" refers to a device that enables shifting of light passing therethrough using a liquid-crystal medium contained in the liquid-crystal structure. In operation, the control circuit applies electrical signals to control the liquid-crystal medium to shift light emanating from the given sub-pixel to the plurality of target positions according to the shifting sequence in a repeated manner. These electrical signals control an orientation of liquid-crystal molecules present in the liquid-crystal medium. Optionally, the liquid-crystal structure comprises a plurality of layers of the liquid-crystal medium that are individually and selectively addressable, wherein a given layer is to be selectively addressed to direct light received thereat from the given sub-pixel or from a previous layer towards a given direction. Optionally, in this regard, the plurality of layers are collectively addressable to direct the light to the plurality of target positions on the image plane, wherein the image plane extends across two directions in which the light is to be directed.

As mentioned earlier, the sub-pixels of the plurality of pixels in the image renderer are arranged in a specific sub-pixel arrangement. A distance between adjacent sub-pixels of a given pixel and a distance between adjacent pixels depends on the sub-pixel arrangement, and in combination with a distance between adjacent target positions govern the extent of overlap between the light emanating from the given sub-pixel and the light emanating from the at least one other sub-pixel. Thus, it will be appreciated that the liquid-crystal device is configured according to the display resolution as well as the specific sub-pixel arrangement of the image renderer.

Pursuant to embodiments, a number of target positions in the plurality of target positions is greater than or equal to two. In some implementations, the plurality of target positions may be arranged in an L×L array, wherein L is selected from the group consisting of 2, 3, 4 and 5. In other implementations, the plurality of target positions may be arranged in an L×M array, wherein L and M could have different values selected from the group consisting of 1, 2, 3, 4 and 5. In yet other implementations, the plurality of target positions may be arranged in a circular array. Some example arrangements have been illustrated in conjunction with FIGS. 3A and 3B. Other arrangements of the plurality of target positions are also possible. It will be appreciated that the plurality of target positions can cover an area of any suitable shape, for example, such as square, rectangular, hexagonal, circular, or the like.

Throughout the present disclosure, the term "shifting sequence" refers to a chronological sequence in which the light emanating from the given sub-pixel is to be shifted to the plurality of target positions repeatedly. The shifting sequence may, for example, be a raster scanning sequence, a random sequence, a Halton sequence (for example, 256 or 1024 first locations of Halton (2, 3)), or similar. It will be appreciated that various shifting sequences are feasible. Some example shifting sequences have been illustrated in conjunction with FIGS. 3C-3F.

In some implementations, the liquid-crystal structure to be electrically controlled in a manner that the given target position overlaps partially with an actual physical position of the at least one other sub-pixel. For illustration purposes only, there will now be considered a first example implementation where the sub-pixels of the image renderer are arranged as follows:

(R1 G1 B1) (R2 G2 B2) (R3 G3 B3) . . .

where:

R1, G1 and B1 are sub-pixels of a first pixel,

R2, G2 and B2 are sub-pixels of a second pixel,

R3, G3 and B3 are sub-pixels of a third pixel, and so on.

In the first example implementation, there will now be considered that light emanating from a given sub-pixel is shifted to four target positions that are arranged in a 2×2 array. It will be appreciated that each sub-pixel has its corresponding four target positions. Let us consider 'R1' as the "given sub-pixel" and a shifting sequence in which light emanating from 'R1' is shifted to:

- a first target position that is an original position of 'R1' during display of an $N^{th}$ output image frame,
- a second target position that lies between an original position of 'G1' and an original position of 'B1', but closer to the original position of 'G1', during display of an $N+1^{th}$ output image frame,
- a third target position that lies between below the second target position during display of an $N+2^{th}$ output image frame,
- a fourth target position that lies on a left side of the third target position during display of an $N+3^{th}$ output image frame,
- the first target position during display of an $N+4^{th}$ output image frame, and so on.

During the display of the $N^{th}$ output image frame, the light emanating from 'R1' is displayed at the first target position, while light emanating from 'G1' and light emanating from 'B1' are displayed at their corresponding first target positions, namely their original positions. When the light emanating from 'R1' is displayed at the second target position during the display of the $N+1^{th}$ output image frame, it overlaps partially with the light that emanated from 'G1' and the light that emanated from 'B1' during the display of the $N^{th}$ output image frame, wherein the extent of overlap is more with the light that emanated from 'G1' as compared to that from 'B1'. Thus, the effect of overlap with the light that emanated from 'G1' during the $N^{th}$ output image frame (which is previous to the $N+1^{th}$ output image frame) is compensated by adjusting an input colour value of 'R1' to generate an output colour value of 'R1' for the $N+1^{th}$ output image frame, based on an output colour value of 'G1' in the $N^{th}$ output image frame and a retention coefficient between green and red.

Moreover, when the aforesaid shifting takes place to cover the four target positions in the 2×2 array, the user perceives one full frame after four consecutive output image frames have been displayed. When these consecutive output image frames are displayed, light emanating from a physical sub-pixel is shifted according to the shifting sequence and displayed at the four target positions as four virtual sub-pixels. In this way, the physical sub-pixel is updated four times to display the four virtual sub-pixels (corresponding to the display of the four consecutive output image frames). By updating the physical sub-pixel, it is meant that the colour value of the physical sub-pixel is updated.

In other implementations, the liquid-crystal structure is to be electrically controlled in a manner that one of the plurality of target positions overlaps with a physical position of the given sub-pixel on the image renderer, and at least two of the plurality of target positions overlap with physical positions of two neighbouring sub-pixels of the given sub-pixel on the image renderer. Herein, the extent of overlap is full. As a result, light emanating from three different sub-pixels during display of corresponding consecutive output image frames overlap fully at a given target position. As the frame rate typically lies in a range of 90-120 frames per second, the light emanating from the three different sub-pixels are combined at the given target position and perceived as a single colour by the user. The technical effect of this feature is that each target location produces a full colour and acts as a pixel, thereby increasing the apparent spatial resolution of the display apparatus as compared to the actual display resolution of the image renderer, whilst providing a sharper visual detail in an image presented by the display apparatus. This produces a picture quality that is unmatched as compared to conventional display apparatuses. In an example case of an RGB sub-pixel arrangement, shifting in a 3×3 array can increase the apparent spatial resolution by nine times of the actual display resolution, as elaborated with an example below.

Hereinabove, a given neighbouring sub-pixel could either be another sub-pixel of a same pixel to which the given sub-pixel belongs or a sub-pixel of a neighbouring pixel. It will be appreciated that one or more sub-pixels may lie between the given sub-pixel and the given neighbouring sub-pixel. The given sub-pixel and the two neighbouring sub-pixels may or may not be arranged along a given direction. For example, they may be arranged along a straight line or on corners of a triangle.

For illustration purposes only, there will now be considered a second example implementation where the sub-pixels of the image renderer are arranged as follows:

(R1 G1 B1) (R2 G2 B2) (R3 G3 B3) . . .

where:

R1, G1 and B1 are sub-pixels of a first pixel,

R2, G2 and B2 are sub-pixels of a second pixel,

R3, G3 and B3 are sub-pixels of a third pixel, and so on.

In the second example implementation, adjacent pixels are beneficially packed tightly, namely arranged closer to each other as compared to the first example implementation. Moreover, in the second example implementation, there will now be considered that light emanating from a given sub-pixel is shifted to nine target positions that are arranged in a 3×3 array. It will be appreciated that each sub-pixel has its corresponding nine target positions.

Let us consider that light emanating from 'R2' is shifted to:

- a corresponding first target position that is an original position of 'R2' during display of an $N^{th}$ output image frame,
- a corresponding second target position that is an original position of 'G2' during display of an $N+1^{th}$ output image frame,
- a corresponding third target position that is an original position of 'B2' during display of an $N+2^{th}$ output image frame,
- a corresponding fourth target position that lies below the third target position during display of an $N+3^{th}$ output image frame,
- a corresponding fifth target position that lies below the fourth target position during display of an $N+4^{th}$ output image frame, a corresponding sixth target position that lies on a left side of the fifth target position during display of an N+5$^{th}$ output image frame, a corresponding seventh target position that lies on a left side of the sixth target position during display of an N+6$^{th}$ output image frame, a corresponding eighth target position that lies above the seventh target position during display of an N+7$^{th}$ output image frame, a corresponding ninth target position that lies on a right side of the eighth target position during display of an N+8$^{th}$ output image frame, the corresponding first target position during display of an N+9$^{th}$ output image frame, and so on.

Likewise, light emanating from 'B1' is shifted to:

its corresponding first target position that is an original position of 'B1' during display of an N$^{th}$ output image frame, its corresponding second target position that is the original position of 'R2' during display of an N+1$^{th}$ output image frame, its corresponding third target position that is the original position of 'G2' during display of an N+2$^{th}$ output image frame, its corresponding fourth target position that lies below the third target position during display of an N+3$^{th}$ output image frame, its corresponding fifth target position that lies below the fourth target position during display of an N+4$^{th}$ output image frame, its corresponding sixth target position that lies on a left side of the fifth target position during display of an N+5$^{th}$ output image frame, its corresponding seventh target position that lies on a left side of the sixth target position during display of an N+6$^{th}$ output image frame, its corresponding eighth target position that lies above the seventh target position during display of an N+7$^{th}$ output image frame, its corresponding ninth target position that lies on a right side of the eighth target position during display of an N+8$^{th}$ output image frame the corresponding first target position during display of an N+9$^{th}$ output image frame, and so on.

Likewise, light emanating from 'G1' is shifted to:

its corresponding first target position that is an original position of 'G1' during display of an N$^{th}$ output image frame, its corresponding second target position that is the original position of 'B1' during display of an N+1$^{th}$ output image frame, its corresponding third target position that is the original position of 'R2' during display of an N+2$^{th}$ output image frame, its corresponding fourth target position that lies below the third target position during display of an N+3$^{th}$ output image frame, its corresponding fifth target position that lies below the fourth target position during display of an N+4$^{th}$ output image frame, its corresponding sixth target position that lies on a left side of the fifth target position during display of an N+5$^{th}$ output image frame, its corresponding seventh target position that lies on a left side of the sixth target position during display of an N+6$^{th}$ output image frame, its corresponding eighth target position that lies above the seventh target position during display of an N+7$^{th}$ output image frame, its corresponding ninth target position that lies on a right side of the eighth target position during display of an N+8$^{th}$ output image frame, the corresponding first target position during display of an N+9$^{th}$ output image frame, and so on.

At the original position of 'R2', the light emanating from 'R2', 'B1' and 'G1' is displayed during the N$^{th}$ output image frame, the N+1$^{th}$ output image frame and the N+2$^{th}$ output image frame, respectively. As the extent of overlap is full, a full colour is produced from a combination of colours produced by 'R2', 'B1' and 'G1' at the original position of 'R2'. As the frame rate typically lies in a range of 90-120 frames per second, light emanating from three different sub-pixels during display of three consecutive output image frames are perceived by the user as a single colour at a given target position. Likewise, a full colour is produced at the original position of each sub-pixel and at two more target positions that lie beneath each sub-pixel. This produces a picture quality that is unmatched as compared to any conventional display apparatus. This works best with sub-pixel arrangements in which three colours are arranged in a row (or in a column) followed by two empty rows (or two empty columns); a distance between adjacent rows (or columns) of sub-pixels is the same as a distance between successive red sub-pixels in a horizontal direction (or a vertical direction), each pixel occupying a square area approximately.

Moreover, when the aforesaid shifting takes place to cover the nine target positions in the 3×3 array, the user perceives one full frame after nine consecutive output image frames have been displayed. When these consecutive output image frames are displayed, light emanating from a physical sub-pixel is shifted according to the shifting sequence and displayed at the nine target positions as nine virtual sub-pixels. However, as the human eye is slow to perceive colours, it does not perceive separate colours (R, G and B) of these sub-pixels, but their combination as the single colour. In this way, the physical sub-pixel is updated nine times to display nine virtual sub-pixels (corresponding to the display of the nine consecutive output image frames).

Optionally, in this regard, the at least one processor is configured to resample output colour values of the sub-pixels of the plurality of pixels for the given output image frame based on corresponding target positions on which light emanating from the sub-pixels is to be shifted. Such resampling is optionally performed in addition to image reprojection that is performed separately for each colour to compensate for chromatic aberration. As the aforesaid resampling takes into consideration an exact target position of each sub-pixel, an accuracy of reprojection is enhanced greatly. In other words, a higher signal reproduction quality is achieved as compared to conventional resampling of output colour values that is performed based on a position of a center of each pixel.

Furthermore, optionally, the at least one processor is configured to select the input colour value of the given sub-pixel from amongst a plurality of input colour values provided for the given sub-pixel in the given input image frame, based on the given target position on the image plane. In such a case, a number of input colour values provided for the given sub-pixel in the given input image frame is equal to the number of target positions in the plurality of target positions. In other words, a number of pixels in a given input image frame is equal to a product of a number of pixels in a given output image frame and the number of target positions. In simple terms, a same physical sub-pixel of the image renderer is utilized to display X different "virtual" sub-pixels in X consecutive output image frames, based on a shifting sequence in which light emanating from the same physical sub-pixel is to be shifted to X target positions, X being equal to or greater than two. Thus, each of the plurality of input colour values provided for the given sub-pixel in the given input image frame maps to a corresponding target position from amongst the plurality of target positions.

Pursuant to embodiments, the at least one processor controls an overall operation of the display apparatus. In particular, the at least one processor is coupled to and controls an operation of the image renderer and an operation of the liquid-crystal device (via the control circuit of the liquid-crystal device). The at least one processor may be implemented at least partly as a compositor (namely, a processor that is configured to perform at least compositing tasks, for example, pertaining to presentation of an XR environment).

The present disclosure also relates to the method as described above. Various embodiments and variants disclosed above, with respect to the aforementioned first aspect, apply mutatis mutandis to the method.

Optionally, in the method, the at least one previous output image frame comprises a first output image frame and a second output image frame, and the at least one other sub-pixel comprises a first sub-pixel and a second sub-pixel, wherein light emanating from the first sub-pixel is shifted to the given target position on the image plane during display of the first output image frame, and light emanating from the second sub-pixel is shifted to the given target position on the image plane during display of the second output image frame, the second output image frame being displayed subsequent to the first output image frame, the given output image frame being displayed subsequent to the second output image frame, wherein the step of adjusting the input colour value of the given sub-pixel comprises applying a first weightage and a second weightage to a first retention coefficient between a colour of the first sub-pixel and the colour of the given sub-pixel and a second retention coefficient between a colour of the second sub-pixel and the colour of the given sub-pixel, respectively, the second weightage being greater than the first weightage.

Optionally, in this regard, the method further comprises determining the first weightage and the second weightage based on the time elapsed from the display of the first output image frame and the second output image frame, respectively, to the display of the given output image frame.

Optionally, the method further comprises determining the retention coefficient between the colour of the at least one other sub-pixel and the colour of the given sub-pixel, based on a frame rate of the image renderer.

Moreover, optionally, in the method, the liquid-crystal structure is electrically controlled in a manner that one of the plurality of target positions overlaps with a physical position of the given sub-pixel on the image renderer, and at least two of the plurality of target positions overlap with physical positions of two neighbouring sub-pixels of the given sub-pixel on the image renderer.

Furthermore, optionally, the method further comprises selecting the input colour value of the given sub-pixel from amongst a plurality of input colour values provided for the given sub-pixel in the given input image frame, based on the given target position on the image plane, wherein a number of input colour values provided for the given sub-pixel in the given input image frame is equal to a number of target positions in the plurality of target positions.

DETAILED DESCRIPTION OF THE DRAWINGS

Referring to FIG. 1, illustrated is a block diagram of architecture of a display apparatus 100, in accordance with an embodiment of the present disclosure. The display apparatus 100 comprises an image renderer 102, a liquid-crystal device 104 and at least one processor, depicted as a processor 106. The liquid crystal device 104 comprises a liquid-crystal structure 108 and a control circuit 110. The liquid-crystal structure 108 is arranged in front of an image-rendering surface of the image renderer 102, wherein the liquid-crystal structure 108 is electrically controlled, via the control circuit 110.

It may be understood by a person skilled in the art that the FIG. 1 includes a simplified architecture of the display apparatus 100, for the sake of clarity, which should not unduly limit the scope of the claims herein. The person skilled in the art will recognize many variations, alternatives, and modifications of embodiments of the present disclosure.

Figure 2:
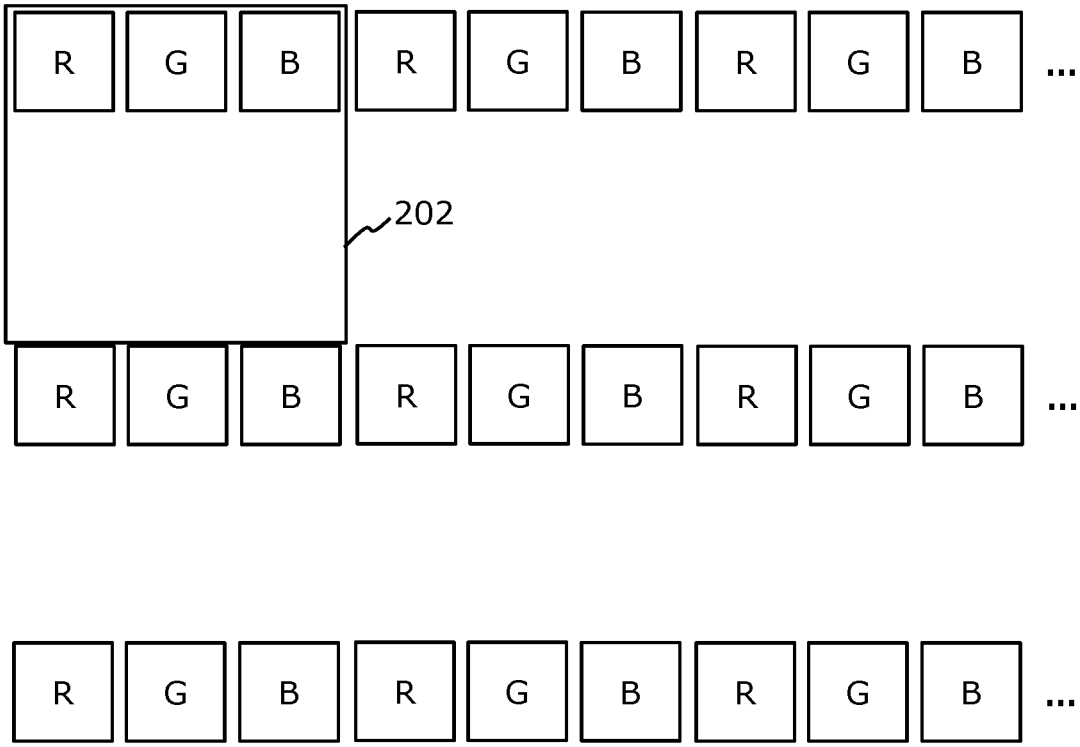
FIG. 2 depicts an example RGB sub-pixel arrangement of an image renderer, which can be employed in various embodiments of the present disclosure.

Referring to FIG. 2, illustrated is an example RGB sub-pixel arrangement of an image renderer, which can be employed in various embodiments of the present disclosure. In FIG. 2, three rows of pixels have been shown for the sake of simplicity and clarity. There are two empty rows between adjacent rows. Each row comprises a plurality of pixels, each of which comprise three sub-pixels, one red, one green and one blue. An area 202 represents an area covered by a given pixel. In accordance with an embodiment of the present disclosure, a plurality of target positions to which light emanating from a red sub-pixel of the given pixel are shifted lie within the area 202.

FIG. 2 is merely an example, which should not unduly limit the scope of the claims herein. The person skilled in the art will recognize many variations, alternatives, and modifications of embodiments of the present disclosure.

Figure 3A:
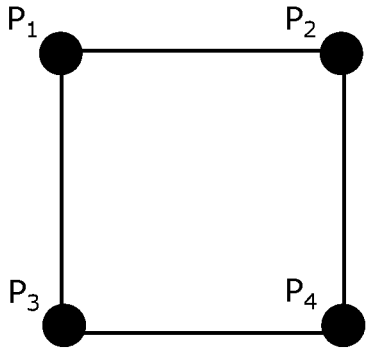
FIGS. 3A and 3B depict example target positions to which light emanating from a given sub-pixel of an image renderer is shifted, in accordance with different embodiments of the present disclosure.
Figure 3B:
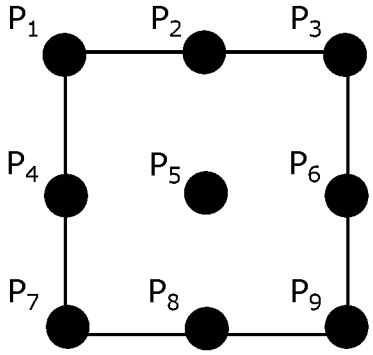

Referring to FIGS. 3A and 3B, illustrated are example target positions to which light emanating from a given sub-pixel of an image renderer is shifted, in accordance with different embodiments of the present disclosure. In FIGS. 3A and 3B, the target positions are represented as blackened circles, and a square outline is depicted merely to show an area where the shifting takes place. Such an area can alternatively have any other suitable shape (for example, such as rectangular, hexagonal, circular, or the like).

In FIG. 3A, the light emanating from the given sub-pixel is shifted to four target positions P1, P2, P3, and P4. These four target positions P1-P4 form a 2×2 array. In FIG. 3B, the light emanating from the given sub-pixel is shifted to nine target positions P1, P2, P3, P4, P5, P6, P7, P8, and P9. These nine target positions P1-P9 form a 3×3 array. It may be understood by a person skilled in the art that the FIGS. 3A and 3B depict exemplary target positions, which should not unduly limit the scope of the claims herein. The person skilled in the art will recognize many variations, alternatives, and modifications of embodiments of the present disclosure. In an example, the light emanating from the given sub-pixel may be shifted to 12 target positions that may be arranged in a 4×3 array. In another example, the light emanating from the given sub-pixel may be shifted to nine target positions that may be arranged in a centred circular array.

Figure 3C:
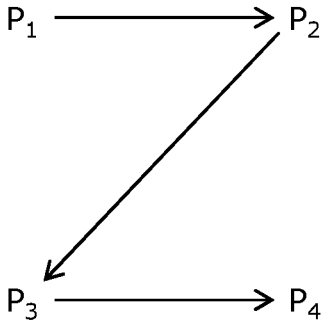
FIGS. 3C-3D and FIGS. 3E-3F depict exemplary shifting sequences for the example target positions depicted in FIG. 3A and FIG. 3B, respectively, in accordance with different embodiments of the present disclosure.
Figure 3D:
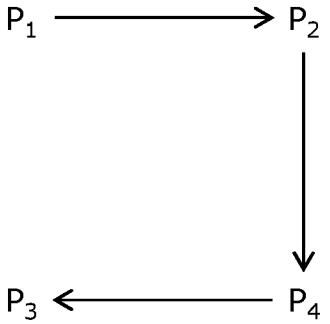

Referring to FIGS. 3C and 3D, illustrated are two exemplary shifting sequences for the four target positions P1-P4 depicted in FIG. 3A, in accordance with different embodiments of the present disclosure. The shifting sequence is indicated by way of arrows. In FIG. 3C, the shifting sequence is: P1, P2, P3, P4. In FIG. 3D, the shifting sequence is: P1, P2, P4, P3.

Figure 3E:
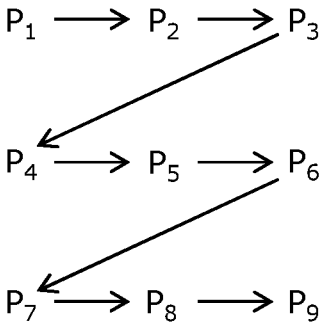
Figure 3F:
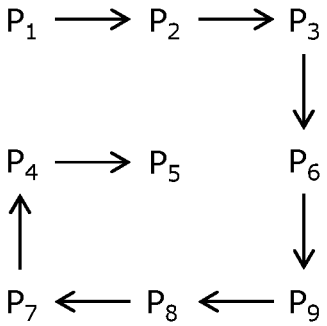

Referring FIGS. 3E and 3F, illustrated are two exemplary shifting sequences for the nine target positions P1-P9 depicted in FIG. 3B, in accordance with different embodiments of the present disclosure. In FIG. 3E, the shifting sequence is: P1, P2, P3, P4, P5, P6, P7, P8, P9. In FIG. 3F, the shifting sequence is: P1, P2, P3, P6, P9, P8, P7, P4, P5.

FIGS. 3C, 3D, 3E and 3F are merely examples, which should not unduly limit the scope of the claims herein. The person skilled in the art will recognize many variations, alternatives, and modifications of embodiments of the present disclosure.

Figure 4:
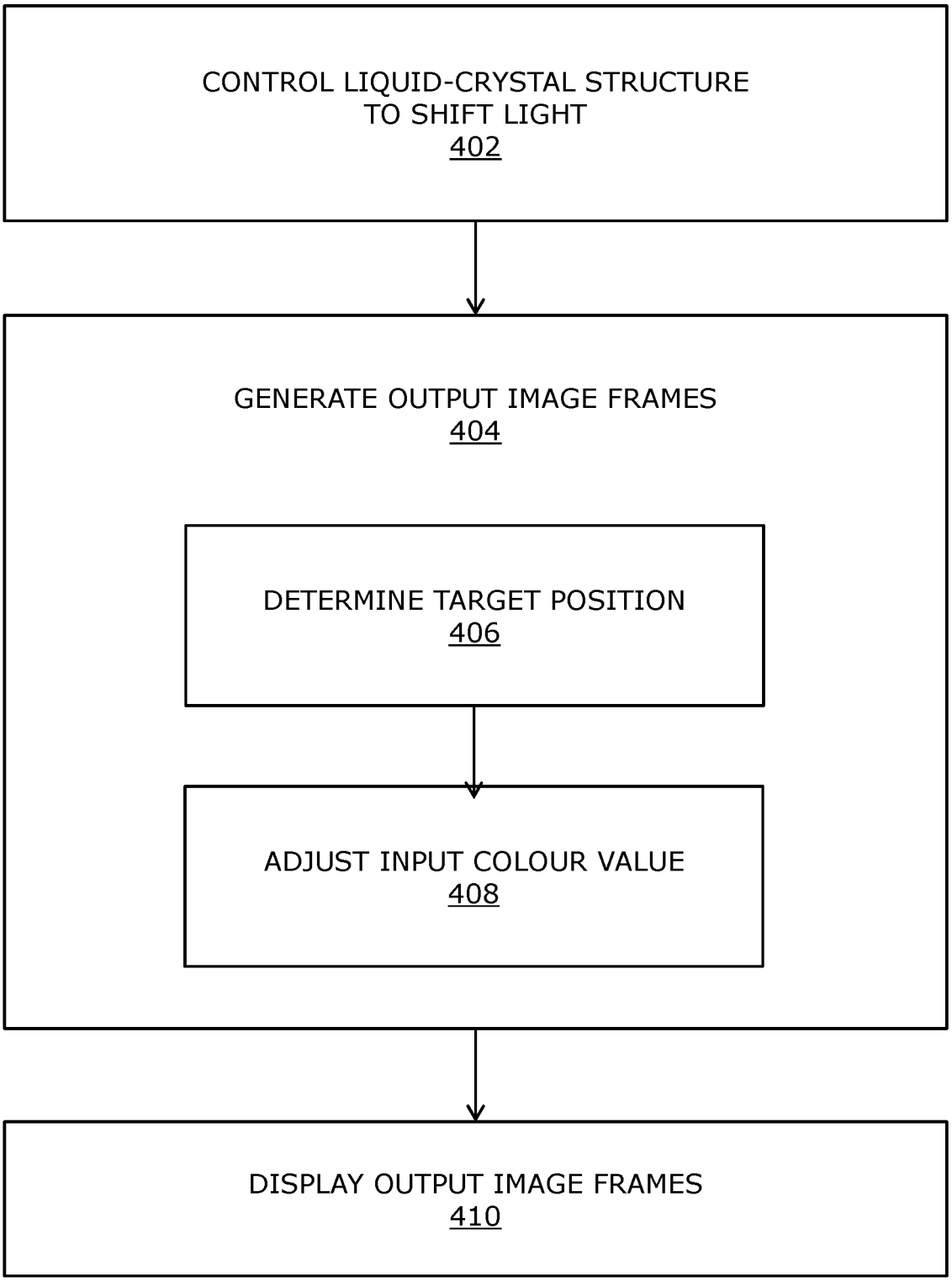
FIG. 4 is a flow chart depicting a method of displaying, in accordance with an embodiment of the present disclosure.

Referring to FIG. 4, illustrated are steps of a method of displaying via a display apparatus, in accordance with an embodiment of the present disclosure. The display apparatus comprises an image renderer and a liquid-crystal device comprising a liquid-crystal structure and a control circuit, wherein the liquid-crystal structure is arranged in front of an image-rendering surface of the image renderer.

At a step 402, the liquid-crystal structure is electrically controlled, via the control circuit, to shift light emanating from a given sub-pixel of the image renderer to a plurality of target positions on an image plane according to a shifting sequence in a repeated manner. At a step 404, an input sequence of input image frames is processed to generate an output sequence of output image frames. The step 404 comprises steps 406 and 408. At the step 406, a given target position on the image plane to which the light emanating from the given sub-pixel of the image renderer is to be shifted during display of a given output image frame is determined, based on the shifting sequence. At the step 408, an input colour value of the given sub-pixel provided in a given input image frame is adjusted to generate an output colour value of the given sub-pixel for the given output image frame, based on an output colour value of at least one other sub-pixel of the image renderer whose light overlaps with the given target position on the image plane during display of at least one previous output image frame, and a retention coefficient between a colour of the at least one other sub-pixel and a colour of the given sub-pixel. Finally, at a step 410, the output image frames are displayed in the output sequence.

The aforementioned steps are only illustrative and other alternatives can also be provided where one or more steps are added, one or more steps are removed, or one or more steps are provided in a different sequence without departing from the scope of the claims herein.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural. It will be appreciated that the terms "first", "second", "third" and the like used herein do not denote any order, quantity or importance, but rather are used to distinguish one element from another.

What is claimed is:

1. A display apparatus comprising:

an image renderer having a plurality of pixels, a given pixel comprising at least three sub-pixels;

a liquid-crystal device comprising a liquid-crystal structure and a control circuit, wherein the liquid-crystal structure is arranged in front of an image-rendering surface of the image renderer, wherein the liquid-crystal structure is to be electrically controlled, via the control circuit, to shift light emanating from a given sub-pixel of the image renderer to a plurality of target positions on an image plane according to a shifting sequence in a repeated manner; and at least one processor configured to:

process an input sequence of input image frames to generate an output sequence of output image frames; and display the output image frames in the output sequence, wherein, when processing a given input image frame to generate a given output image frame, the at least one processor is configured to:

determine a given target position on the image plane to which the light emanating from the given sub-pixel of the image renderer is to be shifted during display of the given output image frame, based on the shifting sequence;

adjust an input colour value of the given sub-pixel provided in the given input image frame to generate an output colour value of the given sub-pixel for the given output image frame, based on:

an output colour value of at least one other sub-pixel of the image renderer whose light overlaps with the given target position on the image plane during display of at least one previous output image frame, and a retention coefficient between a colour of the at least one other sub-pixel and a colour of the given sub-pixel.

2. The display apparatus claim 1, wherein the at least one previous output image frame comprises a first output image frame and a second output image frame, and the at least one other sub-pixel comprises a first sub-pixel and a second sub-pixel, wherein light emanating from the first sub-pixel is shifted to the given target position on the image plane during display of the first output image frame, and light emanating from the second sub-pixel is shifted to the given target position on the image plane during display of the second output image frame, the second output image frame being displayed subsequent to the first output image frame, wherein the given output image frame is to be displayed subsequent to the second output image frame, wherein, when adjusting the input colour value of the given sub-pixel, the at least one processor is configured to apply a first weightage and a second weightage to a first retention coefficient between a colour of the first sub-pixel and the colour of the given sub-pixel and a second retention coefficient between a colour of the second sub-pixel and the colour of the given sub-pixel, respectively, the second weightage being greater than the first weightage.

3. The display apparatus of claim 2, wherein the first weightage and the second weightage are determined based on time elapsed from the display of the first output image frame and the second output image frame, respectively, to the display of the given output image frame.

4. The display apparatus of claim 1, wherein the at least one processor configured to determine the retention coefficient between the colour of the at least one other sub-pixel and the colour of the given sub-pixel, based on a frame rate of the image renderer.

5. The display apparatus of claim 1, wherein the liquid-crystal structure is to be electrically controlled in a manner that one of the plurality of target positions overlaps with a physical position of the given sub-pixel on the image renderer, and at least two of the plurality of target positions overlap with physical positions of two neighbouring sub-pixels of the given sub-pixel on the image renderer.

6. The display apparatus of claim 1, wherein the at least one processor is configured to select the input colour value of the given sub-pixel from amongst a plurality of input colour values provided for the given sub-pixel in the given input image frame, based on the given target position on the image plane, wherein a number of input colour values provided for the given sub-pixel in the given input image frame is equal to a number of target positions in the plurality of target positions.

7. A method of displaying, via a display apparatus comprising an image renderer and a liquid-crystal device, the image renderer having a plurality of pixels, a given pixel comprising at least three sub-pixels, the liquid-crystal device comprising a liquid-crystal structure and a control circuit, wherein the liquid-crystal structure is arranged in front of an image-rendering surface of the image renderer, the method comprising:

electrically controlling the liquid-crystal structure, via the control circuit, to shift light emanating from a given sub-pixel of the image renderer to a plurality of target positions on an image plane according to a shifting sequence in a repeated manner;

processing an input sequence of input image frames to generate an output sequence of output image frames, wherein the step of processing a given input image frame to generate a given output image frame comprises:

determining a given target position on the image plane to which the light emanating from the given sub-pixel of the image renderer is to be shifted during display of the given output image frame, based on the shifting sequence; and adjusting an input colour value of the given sub-pixel provided in the given input image frame to generate an output colour value of the given sub-pixel for the given output image frame, based on an output colour value of at least one other sub-pixel of the image renderer whose light overlaps with the given target position on the image plane during display of at least one previous output image frame, and a retention coefficient between a colour of the at least one other sub-pixel and a colour of the given sub-pixel; and displaying the output image frames in the output sequence.

8. The method of claim 7, wherein the at least one previous output image frame comprises a first output image frame and a second output image frame, and the at least one other sub-pixel comprises a first sub-pixel and a second sub-pixel, wherein light emanating from the first sub-pixel is shifted to the given target position on the image plane during display of the first output image frame, and light emanating from the second sub-pixel is shifted to the given target position on the image plane during display of the second output image frame, the second output image frame being displayed subsequent to the first output image frame, the given output image frame being displayed subsequent to the second output image frame, wherein the step of adjusting the input colour value of the given sub-pixel comprises applying a first weightage and a second weightage to a first retention coefficient between a colour of the first sub-pixel and the colour of the given sub-pixel and a second retention coefficient between a colour of the second sub-pixel and the colour of the given sub-pixel, respectively, the second weightage being greater than the first weightage.

9. The method of claim 8, further comprising determining the first weightage and the second weightage based on time elapsed from the display of the first output image frame and the second output image frame, respectively, to the display of the given output image frame.

10. The method of claim 9, further comprising determining the retention coefficient between the colour of the at least one other sub-pixel and the colour of the given sub-pixel, based on a frame rate of the image renderer.

11. The method of claim 7, wherein the liquid-crystal structure is electrically controlled in a manner that one of the plurality of target positions overlaps with a physical position of the given sub-pixel on the image renderer, and at least two of the plurality of target positions overlap with physical positions of two neighbouring sub-pixels of the given sub-pixel on the image renderer.

12. The method of claim 7, further comprising selecting the input colour value of the given sub-pixel from amongst a plurality of input colour values provided for the given sub-pixel in the given input image frame, based on the given target position on the image plane, wherein a number of input colour values provided for the given sub-pixel in the given input image frame is equal to a number of target positions in the plurality of target positions.

* * * * *